United States Patent [19]

Thiele

[11] 4,303,806

[45] Dec. 1, 1981

[54] DYNAMIC ELECTROACOUSTIC TRANSDUCER HAVING A MOVING COIL IN AN AIR GAP FILLED WITH A MAGNETIC LIQUID

[75] Inventor: Karl-Heinz Thiele, Peine-Stederdorf, Fed. Rep. of Germany

[73] Assignee: Licentia Patent-Verwaltungs-G.m.b.H., Fed. Rep. of Germany

[21] Appl. No.: 107,783

[22] Filed: Dec. 28, 1979

Related U.S. Application Data

[63] Continuation of Ser. No. 940,183, Sep. 7, 1978, abandoned.

[30] Foreign Application Priority Data

Sep. 9, 1977 [DE] Fed. Rep. of Germany ..... 2740661

[51] Int. Cl.[3] ..... H04R 9/06

[52] U.S. Cl. ..... 179/115.5 VC

[58] Field of Search ..... 179/115.5 VC

[56] References Cited

U.S. PATENT DOCUMENTS 1,971,452 8/1934 Herrmann ..... 179/115.5 VC 4,017,694 4/1977 King ..... 179/115.5 VC

*Primary Examiner*—James W. Moffitt

*Attorney, Agent, or Firm*—McGlew and Tuttle

[57] ABSTRACT

A dynamic electroacoustic transducer includes a moving coil which is arranged in an air gap between a pole piece and a pole plate which is filled with a magnetic liquid. At least the outside of the coil has a smooth surface in contact with the magnetic liquid. The coil may also advantageously be wound on a carrier from a wire which is flat at least on one side so that this flat side is turned outwardly and presents a smooth continuous surface. The cross-section of such a wire may advantageously be rectangular. The coil may be coated on its outside surface with a foil of well-conducting material, such as aluminum, or the grooves between a cylindrical coil, for example, may be filled with a lacquer or the like.

10 Claims, 3 Drawing Figures

FIG. 1
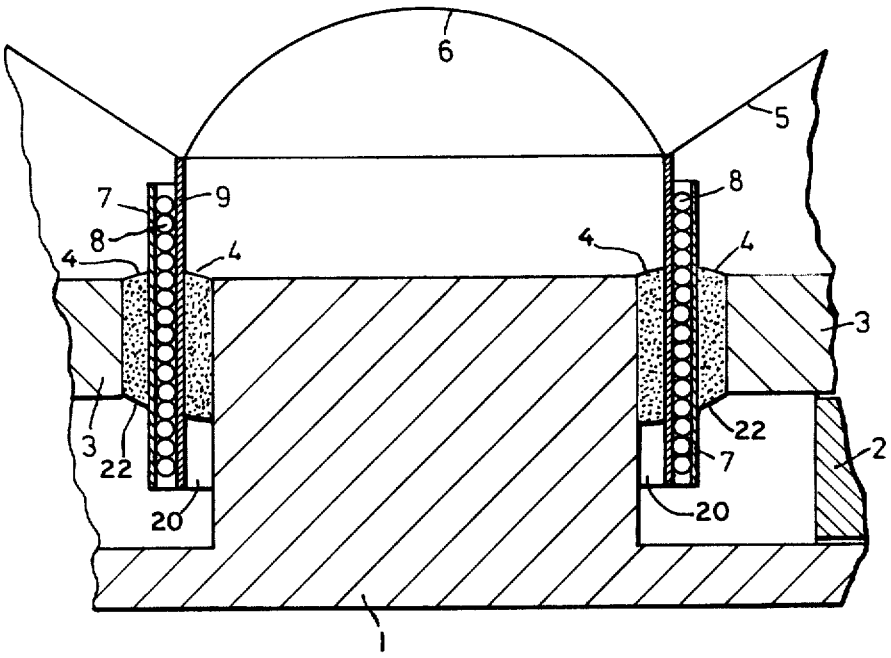
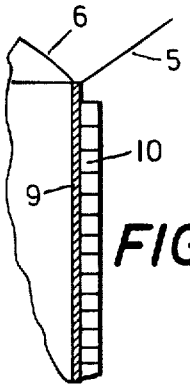
FIG. 2
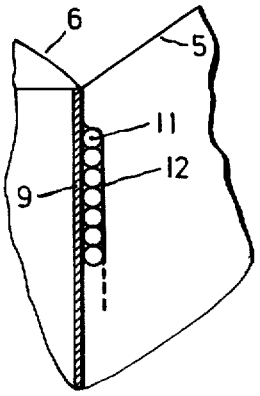
FIG. 3

DYNAMIC ELECTROACOUSTIC TRANSDUCER HAVING A MOVING COIL IN AN AIR GAP FILLED WITH A MAGNETIC LIQUID

This is a continuation of application Ser. No. 940,183 filed Sept. 7, 1978 (now abandoned).

FIELD AND BACKGROUND OF THE INVENTION

This invention relates to the construction of transducers in general and, in particular, to a new and useful dynamic electroacoustic transducer having a moving coil arranged in an air gap which is filled with a magnetic liquid.

DESCRIPTION OF THE PRIOR ART

Dynamic loudspeakers are known, for example, from (Instruments and Control Systems, October 1975, pages 41 to 44), in which the space of the magnet pole assembly in which the coil of the dynamic system is movable and which usually is referred to as the "air gap," is filled with a magnetic liquid. The magnetic liquid is held in place in the air gap by the permanent magnetic field of the system. The motion of the moving coil is damped by the liquid. As compared to conventional dynamic systems with an unfilled air gap, this design also has substantially advantageously improved thermal properties. In comparison with air, the magnetic liquid has a considerably higher thermal conductivity, so that the resistance to heat transfer from the moving coil to the magnet pole body is reduced. The maximum allowable input power of the dynamic system, based on equal maximum temperatures of the moving coil, is thereby increased.

Experience has shown that in transducers in which the moving coils execute relatively long oscillatory motions, for example, in woofers, the adherence of the magnetic liquid in the air gap is unsatisfactory. The liquid volume in the air gap diminishes over an operating period. Aside from this, disturbing secondary noises may occur during the operation of the system, by which the magnetic liquid may be spattered out of the gap.

SUMMARY OF THE INVENTION

The present invention is directed to a dynamic transducer in which the adhesion of the magnetic liquid is improved and, at the same time, disturbing secondary noise is avoided.

In prior art transducers with a magnetic liquid, the purpose of the liquid is to mechanically damp the transducer system. The friction between the wire turns of the moving coil and the magnetic liquid is utilized for the damping. In transducers where the moving coil performs oscillations with a larger amplitude, as in a woofer, the friction may cause an ejection of liquid particles out of the air gap. In addition, a low-frequency, audible disturbing noise is thereby produced. In the inventive transducer, the surface of the moving coil is made continuous and thus, the disturbing friction in the direction of motion of the moving coil is thereby substantially reduced, without affecting the acoustically-effective damping of the transducer system.

Accordingly, it is an object of the invention to provide a dynamic electroacoustic transducer which comprises a pole core base, a pole plate spaced from the base and defining an air gap therebetween and a moving coil disposed around the pole core base and being movable in the air gap and having at least on its exterior or outer surface, a magnetic field in the air gap and having a surface in contact with the magnetic field which is smooth.

A further object of the invention is to provide a dynamic electroacoustic transducer which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 1 is a partial transverse sectional view of a transducer system of a dynamic woofer having a moving coil and constructed in accordance with the invention;

FIG. 2 is a partial sectional view, similar to FIG. 1 of another embodiment of the invention; and FIG. 3 is a view similar to FIG. 1 of still another embodiment of the invention.

DESCRIPTION OF THE PREFERRED EMBODIMENTS

Referring to the drawings in particular, the invention embodied therein in FIG. 1 shows a sectional view of a transducer system of a woofer, comprising, a cone 5, a cup-shaped central portion 6, a moving coil carrier 9 connected to the cone and the winding 8 of the moving coil. The moving coil extends into the air gap of a magnet pole assembly comprising a pole core with a base 1, an annular permanent magnet 2 and a pole plate 3. Air gaps 20 and 22 at both sides of the moving coil 8 are filled with a magnetic liquid 4. The coil winding 8 is coated on its outside with a smooth foil 7. Thus, the magnetic liquid is not in contact with the moving coil winding 8, but contacts the continuous foil 7 or the carrier 9.

Advantageously, a thermally well-conducting material, for example, aluminum, is used for foil 7. A heat transfer from the moving coil winding 8 through foil 7 and magnetic liquid 4 into pole plate 3 is thereby made possible. If a foil 7 of an electrically conducting material is used, a slit extending over the entire length of coil winding 8 may be provided, preventing the foil 7 from acting as a short-circuited winding for the moving coil 8. Foil 7 is glued to moving coil 8.

FIG. 2 shows another embodiment for obtaining a smooth surface of the moving coil. The moving coil shown at 10 is wound on a moving coil carrier 9 from a wire having a rectangular cross-section. The use of a wire having a rectangular cross-section improves the so-called copper factor and, thereby, the efficiency of the system.

In FIG. 3, the surface of the moving coil designated 11 is smoothed by means of a lacquer 12. The grooves or gaps between the individual wire turns of moving coil 11 are filled with lacquer 12, so that the contact surface with the magnetic liquid becomes smooth. Advantageously, a lacquer or adhesive having a high surface tension in liquid state and a low viscosity are used.

While specific embodiments of the invention have been shown and described in detail to illustrate the application of the principles of the invention, it will be understood that the invention may be embodied otherwise without departing from such principles.

What is claimed is:

1. A dynamic electroacoustic transducer, comprising a pole core base, a pole plate spaced from said base and defining an air gap therebetween, a moving coil disposed around said pole core base and being movable in the air gap, said coil extending beyond each end of said air gap, a magnetic liquid in said gap at least at the side of said coil remote from said pole core base, and smooth continuous surface means on said coil in contact with said magnetic liquid for separating said moving coil from contact with said magnetic liquid in said gap, said smooth continuous surface means being disposed intermediate said moving coil and said magnetic liquid on the side of said moving coil remote from said pole core base.

2. A dynamic electroacoustic transducer, as claimed in claim 1, including a carrier disposed around said core base, and wherein said moving coil includes a wire wound around said carrier having a side remote from said pole core base with a smooth continuous flat surface.

3. A dynamic electroacoustic transducer, as claimed in claim 2, wherein said wire has a rectangular cross-section.

4. A dynamic electroacoustic transducer, as claimed in claim 3, wherein said smooth continuous surface means includes a foil disposed around said coil on the side of said coil remote from said pole core base.

5. A dynamic electroacoustic transducer, as claimed in claim 4, wherein said foil is of thermally wellconducting material.

6. A dynamic electroacoustic transducer, as claimed in claim 5, wherein said foil is aluminum.

7. A dynamic electroacoustic transducer as claimed in claim 6, wherein said coil has a plurality of turns, and said surface means includes a lacquer coating said coil and filling the spaces therebetween.

8. A dynamic electroacoustic transducer, as claimed in claim 7, wherein said lacquer has a high surface tension in a liquid state and a low viscosity.

9. A dynamic electroacoustic transducer, as claimed in claim 1, wherein said plate comprises an annular plate disposed around said core base, a tubular carrier disposed around said base between said plate and said core base, said coil comprising a winding around said carrier and said surface means comprising a foil disposed around said coi.

10. A dynamic electroacoustic transducer, as claimed in claim 1, wherein said smooth continuous surface means includes a foil disposed around said coil on the side of said coil remote from said pole core base, and a moving coil carrier, said coil being mounted to said moving coil carrier on the side of said coil adjacent said pole core base.

* * * * *